US007377509B2

(12) United States Patent
Ito

(10) Patent No.: US 7,377,509 B2
(45) Date of Patent: May 27, 2008

(54) SHEET FEED CASSETTE

(75) Inventor: Yoshiyuki Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 538 days.

(21) Appl. No.: 10/808,334

(22) Filed: Mar. 25, 2004

(65) Prior Publication Data

US 2004/0188924 A1 Sep. 30, 2004

(30) Foreign Application Priority Data

Mar. 28, 2003 (JP) ..... 2003-090335

(51) Int. Cl.
*B65H 1/00* (2006.01)

(52) U.S. Cl. ..... 271/171

(58) Field of Classification Search ..... 271/145, 271/171

See application file for complete search history.

(56) References Cited

U.S. PATENT DOCUMENTS

| | | | | |
|---|---|---|---|---|
| 5,029,841 | A * | 7/1991 | Ettischer et al. | 271/171 |
| 5,628,504 | A * | 5/1997 | Lyga | 271/171 |
| 5,709,382 | A * | 1/1998 | Shima | 271/209 |
| 5,927,707 | A * | 7/1999 | Miura | 271/171 |
| 5,931,456 | A * | 8/1999 | Laidlaw | 271/171 |
| 6,169,561 | B1 * | 1/2001 | Fisher, Sr. | 347/218 |
| 6,182,963 | B1 * | 2/2001 | Yergenson | 271/160 |
| 6,267,371 | B1 * | 7/2001 | Jessop | 271/171 |
| 6,409,165 | B1 * | 6/2002 | Yamaoka et al. | 271/145 |
| 6,581,928 | B1 * | 6/2003 | Stephan | 271/188 |
| 6,644,502 | B2 * | 11/2003 | Pearce et al. | 221/127 |
| 6,688,592 | B1 * | 2/2004 | Tan et al. | 271/171 |
| 6,793,215 | B2 * | 9/2004 | Salomon | 271/171 |
| 2005/0062218 | A1 * | 3/2005 | Murakami et al. | 271/171 |
| 2005/0151315 | A1 * | 7/2005 | Yokoi | 271/145 |

FOREIGN PATENT DOCUMENTS

| | | | |
|---|---|---|---|
| JP | 04286549 | A * | 10/1992 |
| JP | A 5-186059 | | 7/1993 |
| JP | 05201555 | A * | 8/1993 |
| JP | A 5-262433 | | 10/1993 |
| JP | 05294471 | A * | 11/1993 |
| JP | 06064770 | A * | 3/1994 |
| JP | A 7-285697 | | 10/1995 |
| JP | A 8-12101 | | 1/1996 |

* cited by examiner

*Primary Examiner*—Patrick H. Mackey
*Assistant Examiner*—Jeremy R Severson
(74) *Attorney, Agent, or Firm*—Oliff & Berridge, PLC

(57) ABSTRACT

A sheet feed cassette includes a case, and right and left guide members that are disposed in the case and guide edges of a sheet parallel with a sheet feeding direction. The guide members are movable in a sheet width direction in synchronization with each other. The guide members are adjusted in association with a size of the sheet to be accommodated in a sheet accommodation area. The right guide member includes a slide member and a leaf spring attached to the slide member. As the right guide member is moved toward a side wall of the case, a protrusion extending from the side wall contacts the leaf spring, through a slit formed on the slide member. The leaf spring is deformed and the sheet accommodation area in the case gradually becomes larger toward a sheet stacking direction from a bottom of the case.

20 Claims, 9 Drawing Sheets

SHEET FEED CASSETTE

BACKGROUND OF THE INVENTION

1. Field of Invention

The invention relates to a sheet feed cassette and an image forming device provided with the sheet feed cassette.

2. Description of Related Art

A sheet feed cassette that mounts thereon sheets as recording media is removably provided in a known image forming device, such a printer. The sheet feed cassette disclosed in, for example, Japanese Laid-Open Patent Publication No. 8-12101 includes a sheet guide member that guides a parallel edge of a sheet to a sheet feeding direction. The sheet guide member is movable in a sheet width direction to correspond to widths of various sizes of sheets. The sheet guide member includes a slide member and a leaf spring attached to the slide member on a side that faces the sheets mounted on the sheet feed cassette. The sheets are placed in position in the sheet feed cassette by an urging force of the leaf spring.

In recent years, demands to reduce the physical size of printers, and consequently reducing the size of the sheet feed cassette are increasing. Therefore, a compact design of the sheet feed cassette that is slightly larger than the maximum sheet size that the sheet feed cassette can handle, is desired. More specifically, it is preferred that the sheet feed cassette have a bottom whose area is slightly larger than the area of the maximum sheet size handled by the sheet feed cassette, as well as a guide member designed to allow the sheets of the maximum size to fit in the sheet feed cassette when the guide member is moved sideways to its limit.

SUMMARY OF THE INVENTION

When the sheets with the maximum size are to be set in the sheet feed cassette designed as described above, it becomes difficult setting the sheets in the cassette because the sheets tend to contact or hit on an upper end of the leaf spring. The sheets are thus damaged if the sheets are forcibly set in the cassette.

Accordingly, one exemplary aspect of the invention is to provide a sheet feed cassette that allows recording media to be readily set therein without increasing the size of the sheet feed cassette and an image forming device provided with the sheet feed cassette.

According to one exemplary aspect of the invention, a sheet feed cassette may include a case that accommodates a stack of recording mediums, a slide member, provided inside of the case, slidably disposed in association with a size of the stack of recording mediums, the case and the slide member determining an accommodating area that accommodates the stack of recording mediums, an urging member, provided at the slide member in facing one side of the stack of recording mediums, that urges the one side of the stack of recording mediums, and an actuator that transforms the urging member such that the accommodating area at a top portion of the case is larger than the accommodating area at a bottom portion of the case.

According to another exemplary aspect of the invention, the sheet feed cassette may include a case that accommodates a stack of recording mediums, a slide member, provided inside of the case, slidably disposed in association with a size of the stack of recording mediums, the case and the slide member determining an accommodating area that accommodates the stack of recording mediums, and an urging member, provided at the slide member that faces one side of the stack of recording mediums, that is movable between a first position where a side of the slide member and a side of the urging member that faces the stack of recording mediums is substantially parallel and a second position where the side of the slide member and the side of the urging member that faces the stack of recording mediums is not substantially parallel.

BRIEF DESCRIPTION OF THE DRAWINGS

An embodiment of the invention will be described in detail with reference to the following figures in which like elements are labeled with like numbers and in which.

DETAILED DESCRIPTION OF PREFERRED EMBODIMENTS

Figure 1:
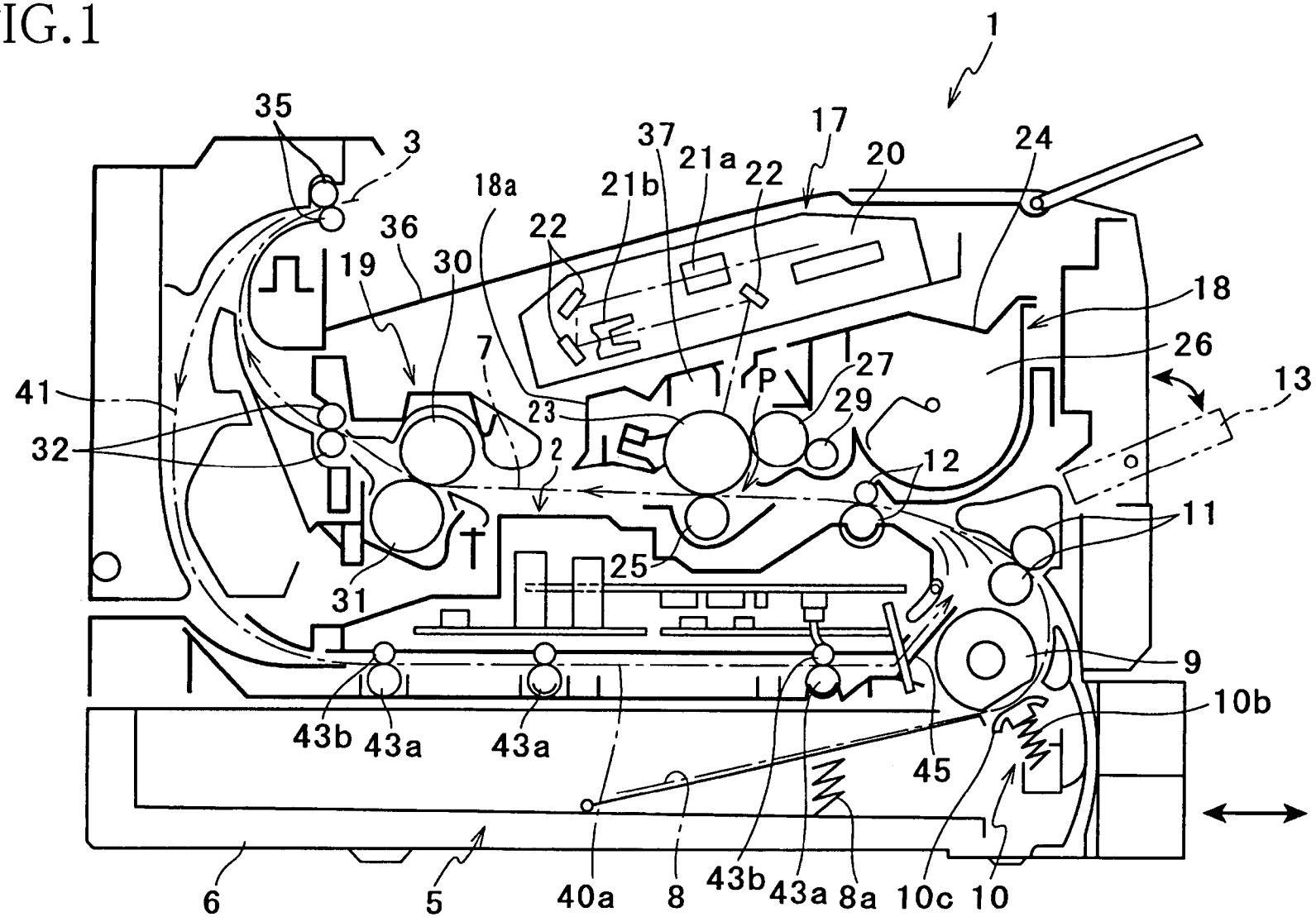
FIG. 1 is a cross sectional view of a laser printer according to an embodiment of the invention.

An embodiment of the invention will be described in detail with reference to the figures. With reference to FIG. 1, a laser printer 1 according to an embodiment of the invention will be described. The right and left sides of the laser printer 1 in FIG. 1 are defined as front and rear sides of the laser printer 1, respectively.

Disposed at a lower portion of the laser printer 1 is a sheet feeder section 5 for feeding cut sheets 3 as recording media. The laser printer 1 includes a process unit 18 and a scanner unit 17 that form an image onto a fed sheet 3, and a fixing unit 19 that thermally fixes the image on the sheet 3.

The sheet feeder section 5 includes a sheet feed cassette 6 removably set in a main frame 2, a sheet mount plate 8 disposed in the sheet feed cassette 6, a substantially semi-circular pick-up roller 9 that is disposed above an end of the sheet feed cassette 6 and intermittently rotates, and a separation pad unit 10 disposed to face the pick-up roller 9.

The sheet mount plate 8 supports a stack of the sheets 3 thereon. The sheet mount plate 8 is urged upwardly at an underside thereof by a spring 8*a* to pivot on one end far from the pick-up roller 9, so that the other end of the sheet mount plate 8 near the pick-up roller 9 can move up and down. With a spring 10*b* of the separation pad unit 10 disposed on an underside of a pad supporting member 10*c*, a separation pad (not shown) formed of a material having a high friction resistance is pressed against the pick-up roller 9.

Widths of the separation pad and the pick-up roller 9 in a direction perpendicular to a sheet feeding direction are shorter than the width of the sheet 3. When the sheet 3 is picked up and fed by the pick-up roller 9, the separation pad and the pick-up roller 9 contact a substantially central portion of the sheet 3 in the sheet width direction.

A sheet transport path 7, as shown by alternate long and short dash line in FIG. 1, is formed from the pick-up roller 9 to discharge rollers 35, through an image forming position P of a contact portion between a photosensitive drum 23 and a transfer roller 25 where an toner image on the photosensitive drum 23 is transferred on the sheet 3. A pair of feed rollers 11 and a pair of register rollers 12 are disposed, between the pick-up roller 9 and the image forming position P, along the sheet transport path 7 with some distance between the pairs of rollers 11, 12.

The uppermost sheet 3 on the sheet mount plate 8 is pressed against the pick-up roller 9. By the rotation of the pick-up roller 9, the sheet 3 is held between the pick-up roller 9 and the separation pad unit 10 and fed to the feed rollers 11 and the register rollers 12. Thus, the sheets P on the sheet mount plate 8 are separated and fed one by one in the sheet feeding direction. The alignment or skew of the sheet 3 is corrected with the register rollers 12, as will be described in detail below, and then fed to the image forming position P for image formation with the process unit 18.

A manual feed tray 13 for supplying the sheets 3 manually set thereon is pivotally provided downstream of the feed rollers 11 in the sheet feeding direction, so as to open and close.

A scanner unit 17 is disposed above the process unit 18. The scanner unit 17 includes a laser emitting section (not shown), a polygon mirror 20 that is driven so as to spin, lenses 21*a*, 21*b*, and reflecting mirrors 22. A laser beam emitted from the laser emitting section based on image data passes through or reflects off the polygon mirror 20, the lens 21*a*, the reflecting mirrors 22, and the lens 21*b*, in this order. The laser beam scans at a high speed across a surface of the photosensitive drum 23.

The process unit 18 includes a photosensitive member cartridge 18*a* and a developing cartridge 24 detachably mounted on the photosensitive member cartridge 18*a*. The photosensitive member cartridge 18*a* includes the photosensitive drum 23, a scorotron charger 37, and a transfer roller 25. The developing cartridge 24 includes a toner box 26, a developing roller 27, a toner layer thickness regulating blade (not shown), and a toner supply roller 29.

The toner box 26 accommodates positively chargeable non-magnetic single component polymerized toner, as a developing agent. The toner is supplied to the developing roller 27 by the toner supply roller 29. The toner is positively charged by the friction between the toner supply roller 29 and the developing roller 27. As the developing roller 27 rotates, the toner is carried on the developing roller 27 as a constant thin thickness toner layer because of a frictional sliding relation with the toner layer thickness regulating blade. The photosensitive drum 23 is rotatably disposed in confronting relation to the developing roller 27. The photosensitive drum 23 includes a drum body which is grounded, and a positively chargeable photosensitive layer made from organic photosensitive material of, for example, polycarbonate formed over the drum body.

The scorotron charger 37 is disposed above the photosensitive drum 23 with a predetermined distance therebetween, to prevent the charger 37 from contacting the photosensitive drum 23. The charger 37 is a positively charging scorotron charger that generates corona discharge from a tungsten wire. The charger 37 uniformly and positively charges the surface of the photosensitive drum 23.

The laser beam emitted from the scanner unit 17 scans at a high speed across the surface of the photosensitive drum 23, which is uniformly and positively charged by the charger 37 while the photosensitive drum 23 is rotated. The surface of the photosensitive drum 23 is selectively exposed to the laser beam, forming an electrostatic latent image thereon, based on image data. By the rotation of the developing roller 27 having the positively charged toner thereon, the toner is brought into contact with the photosensitive drum 23. The toner is supplied to the electrostatic latent image formed on the surface of the photosensitive drum 23, making the toner image visible. In other words, the toner is supplied to parts of the photosensitive drum 23 selectively exposed to the laser beam where the potential level is lower than the remaining part of the photosensitive drum 23 surface uniformly positively charged. Thus, the visible toner image is formed on the photosensitive drum 23.

The transfer roller 25 is positioned immediately below the photosensitive drum 23. The transfer roller 25 includes a metal roller shaft covered by a roller portion formed of ionic conductive rubber. A transfer bias is applied to the transfer roller 25 by a transfer bias application power source (not shown). By the application of the transfer bias, the visible toner image on the photosensitive drum 23 is transferred onto the sheet 3 while the sheet 3 passes between the photosensitive drum 23 and the transfer roller 25.

The fixing unit 19 is positioned downstream of the process unit 18 in the sheet feeding direction. The fixing unit 19 includes a heat roller 30, a pressure roller 31 in pressure contact with the heat roller 30, and a pair of feed rollers 32 positioned downstream of the heat roller 30 and the pressure roller 31. The heat roller 30 is made from a metal, such as aluminum and is provided with a halogen lamp as a heat source. The toner image transferred onto the sheet 3 at the process unit 18 is thermally fixed to the sheet 3 while the sheet 3 passes between the heat roller 30 and the pressure roller 31. The sheet 3 is then delivered to the feed rollers 32 and discharge rollers 35. The sheet 3 having the image formed thereon is discharged onto a discharge tray 36 by way of the discharge rollers 35.

The laser printer 1 is capable of forming an image on a single or both side(s) of the sheet 3. It is selected whether the sheet 3 fed to the discharge rollers 35 is discharged onto the discharge tray 36 or further subjected to printing on the rear side thereof. A double-sided printing operation performed for both sides of the sheet 3 will be described in detail below.

When the double-sided printing is selected, the sheet 3 fed to the discharge rollers 35 after an image is formed on one side thereof, is turned upside down by the discharge rollers 35 reversely rotating and fed to a reverse path 41 and a re-circulation path 40*a* connected thereto. The sheet 3 is fed to the register rollers 12, though a re-circulation guide 45, while being held between a plurality of pairs of re-circulation feed rollers 43*a*, 43*b*. An image is formed on the other side of the sheet 3 in the process unit 18. Thereafter, the sheet 3 is discharged onto the discharge tray 36 by the rotation of the discharge rollers 35.

Figure 2A:
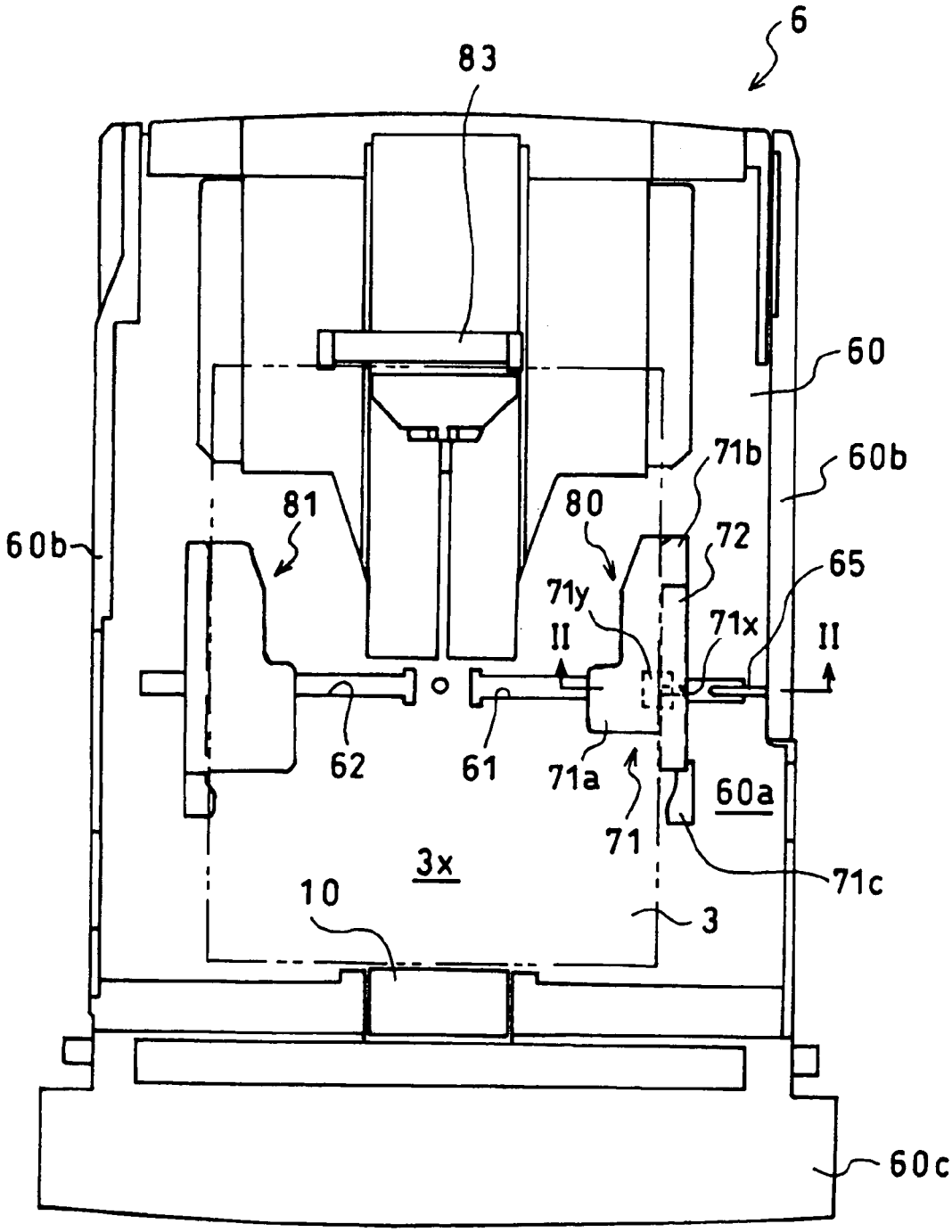
FIG. 2A is a plane view of a sheet feed cassette of the laser printer in which A4-sized sheets are mountable.
Figure 2B:
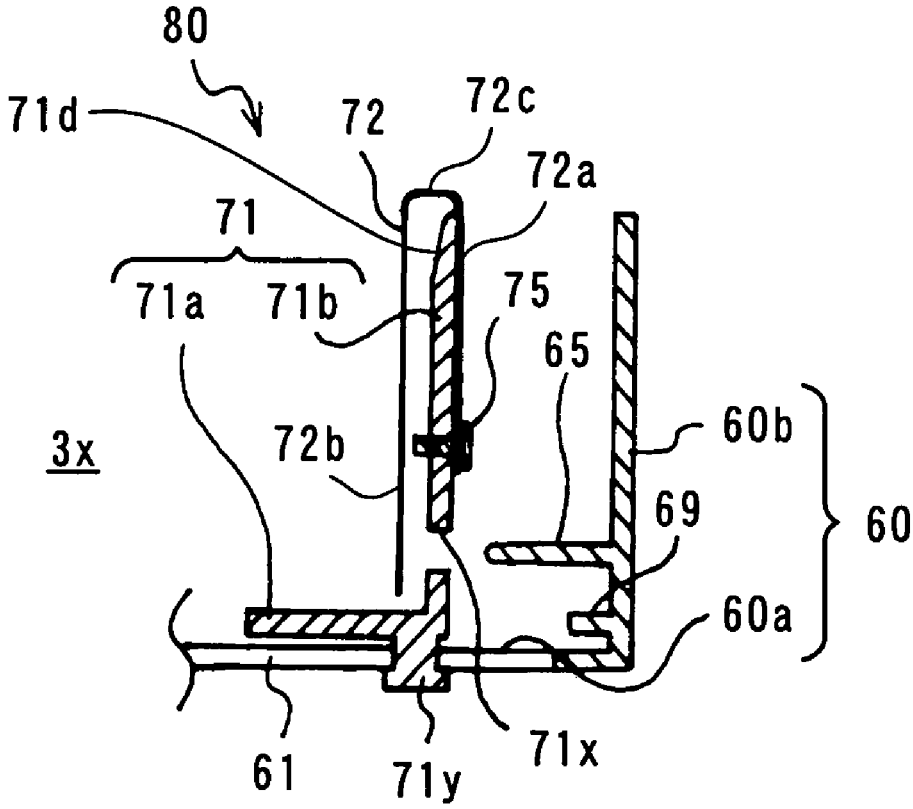
FIG. 2B is a cross sectional view of the sheet feed cassette taken along the line II-II of FIG. 2A.

With reference to FIGS. 2A and 2B, the sheet feed cassette 6 detachably mounted on a lower part of the laser printer 1 will be described in detail below. The sheet feed cassette 6 can accommodate at least two different sizes of sheets 3, i.e., A4 and B4-sized sheets. The sheet feed cassette 6 adopts a center registration system in which the sheets 3 are set in the cassette 6, taking a center line in the cassette 6 as a reference for feeding the sheet 3. As shown in FIG. 2A, the sheet feed cassette 6 includes a case 60 that mounts a stack of the sheets 3, and guide members 80, 81 provided in the case 60 and movable in the sheet width direction in association with the sheet sizes. In this embodiment, the sheet 3 is fed in the longitudinal direction thereof and the guide members 80, 81 guides longer sides of the sheets 3.

The case 60 is made of, for example, resin material. The case 60 has a substantially rectangular bottom 60*a* slightly larger than the B4-sized sheet 3, which is the maximum sheet size that can be placed in the cassette 6, right and left side walls 60*b* provided uprightly on each side of the bottom 60*a*, and a grip 60*c* provided on a front (lower side in FIG. 2A) of the sheet feed cassette 6 when the cassette 6 is set in the printer 1. By handling the grip 60*c*, the cassette 6 is moved frontward or rearward to removably set the cassette 6 in the laser printer 1.

The guide members 80, 81 are provided in the case 60 on the right and left sides across a central portion thereof, to support longer sides of the sheet 3. The guide members 80, 81 are movable in the sheet width direction (right and left sides in FIG. 2A) in synchronization with each other. More specifically, when the right guide member 80 is moved to the right or left, the left guide member 81 is moved in an opposite direction by the same distance. The guide members 80, 81 have different structures. The right guide member 80 includes a slide member 71 and the leaf spring 72 attached to the slide member 71. The left guide member 81 includes a slide member but does not include a leaf spring.

Disposed on an inner rear side (upper side in FIG. 2A) of the case 60 opposite from the grip 60*c* is a rear end restricting member 83 that restricts the position of the rear end of the sheet 3. The rear end restricting member 83 is movable in a direction perpendicular to a moving direction of the guide members 80, 81.

A sheet accommodation area 3*x* is a substantially rectangular area in plane view enclosed by inner faces of the separation pad unit 10, the rear end restricting member 83, the leaf spring 72 of the right guide member 80, and the left guide member 81. By moving the rear end restricting member 83 and the guide members 80, 81, the size of the sheet accommodation area 3*x* is adjusted in accordance with the sizes of the sheets 3 to be set in the cassette 6. The sheet accommodation area 3*x* shown in FIG. 2A corresponds to the size of the A4-sized sheet 3.

The right guide member 80 is described in detail below with reference to FIGS. 2A through 4B. As described above, the right guide member 80 includes the slide member 71 and the leaf spring 72 attached to the slide member 71. As shown in FIG. 2A, the slide member 71 includes a bottom 71*a* parallel to the bottom 60*a* of the case 60, a side 71*b* provided vertical to the bottom 60*a*, a handle 71*c* provided on an upper front portion of the side 71*b*, and a tapered portion 71*d* formed on an upper inner portion of the side 71*b* (left side of the side 71*b* in FIG. 2B).

As shown in FIG. 2A, the bottom 71*a* has a substantially reversed "L" shaped surface. The bottom 60*a* of the case 60 has a slide opening 61 elongated in the sheet width direction. A sliding portion 71*y* that fits in the slide opening 61 is provided near the border between the bottom 71*a* and the side 71*b*. As show in FIG. 3, the sliding portion 71*y* passes through the slide opening 61. The slide member 71 is slidable in the sheet width direction along the slide opening 61.

The side 71*b* of the slide member 71 has a substantially rectangular surface. As shown in FIG. 2B, a slot 71*x* is formed on the side 71*b* at a portion lower than the central portion of the side 71*b* near the bottom 60*a*, in association with a protrusion 65, as an example of an actuator, formed on the side wall 60*b* of the case 60. The slot 71*x* is formed into a substantially rectangular shape, as shown in FIG. 3, enough to fit over the protrusion 65.

As shown in FIGS. 2A and 2B, the protrusion 65 is disposed perpendicular to the side wall 60*b* to extend from an inner surface of the side wall 60*b* toward the side 71*b* and the leaf spring 72. As shown in FIG. 2B, the protrusion 65 is disposed lower than the center of the side 71*b* and the leaf spring 72. The end of the protrusion 65 where the protrusion 65 contacts the leaf spring 72, is rounded.

As shown in FIG. 2B, a projection 69 shorter than the protrusion 65 is disposed below the protrusion 65, to extend in the same direction as the protrusion 65. The projection 69 restricts the movement of the right guide member 80, as will be described in detail below.

Figure 3:
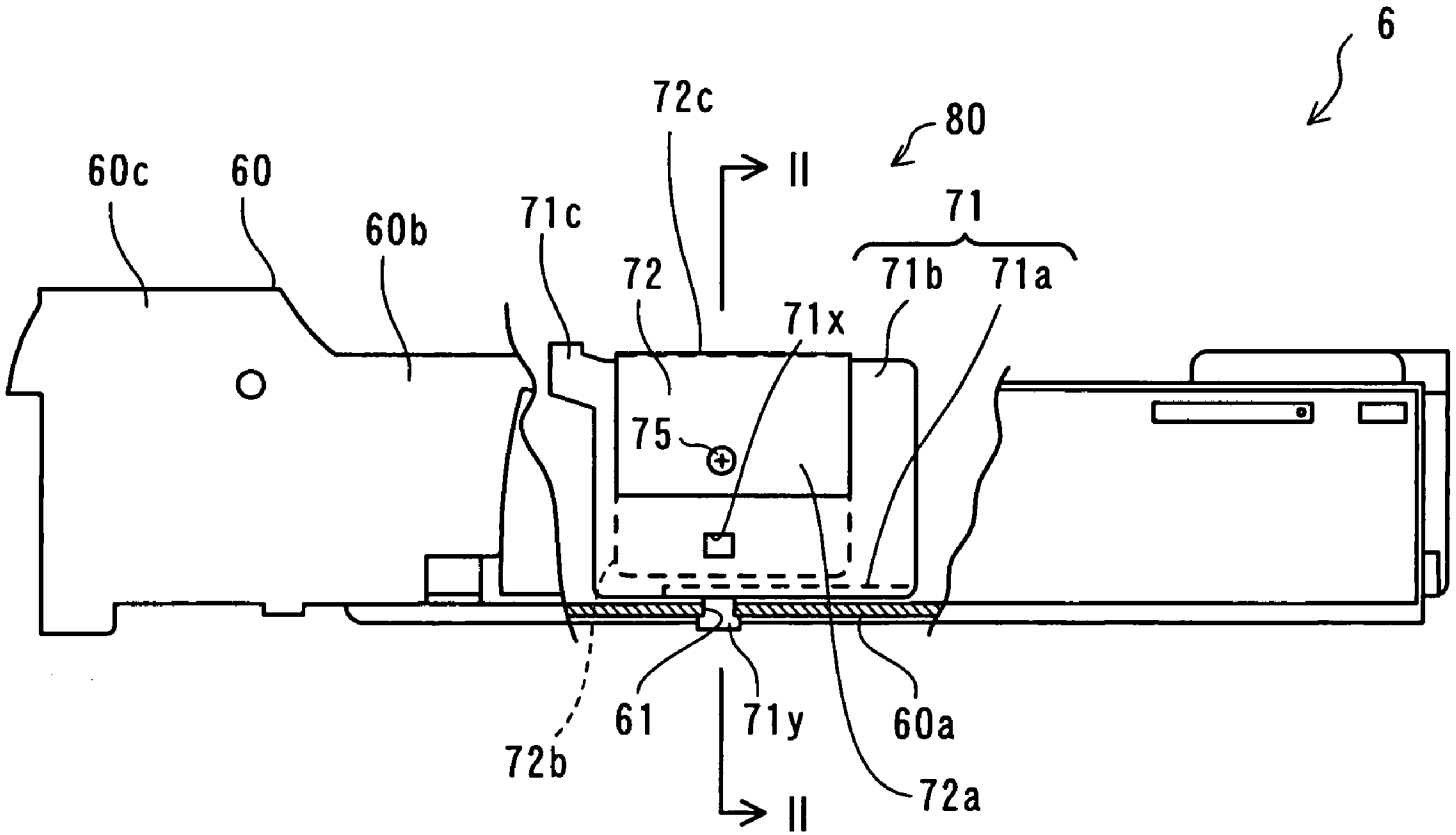
FIG. 3 is a partial cutaway side view of the sheet feed cassette.

The handle 71*c* is provided to extend in an upward slanting direction toward the front side of the laser printer 1, as will be best seen in FIG. 3. The handle 71*c* is used by a user to move the right guide member 80 sideways.

As shown in FIG. 2B, the leaf spring 72 includes a fixed side 72*a* that is fixed on the side 71*b* of the slide member 71, a free side 72*b* that is not fixed on the leaf spring 72, and a curved connecting portion 72*c* that connects the fixed side 72*a* and the free side 72*b*. As shown in FIG. 3, the leaf spring 72 is a plate-like member with a dimension in the sheet feeding direction (right and left direction FIG. 3) shorter than that of the side 71*b* of the slide member 71. As shown in FIG. 2B, the leaf spring 72 is fixed on the side 71*b* at the fixed side 72*a* such that the upper end of the side 71*b* is fitted in the curvature of the connecting portion 72*c*. The leaf spring 72 and the side 71*b* are fixed at a position higher than the slot 71*x* by a screw 75. The leaf spring 72 urges the longer sides of the sheets 3 (right-side edges of the sheets 3 in FIG. 2A).

A screw hole (not shown) for the screw 75 is formed on the side 71*b* and the fixed side 72*a* of the leaf spring 72. The screw 75 is inserted from the fixed side 72*a* into the side 71*b*. The free side 72*b* of the leaf spring 72 is not fixed by the screw 75.

Setting of different sized sheets 3, for example, changes of the sheets 3 from A4-sized sheets 3, which fit in the sheet accommodation area 3*x* shown in FIGS. 2A and 2B, to B4-sized sheets 3, which fit in the sheet accommodation area 3*x* shown in FIGS. 4A and 4B, will be described below.

The right guide member 80 is moved to a side approaching the side wall 60*b* (to the right in FIG. 2B), so that the protrusion 65 provided on the side wall 60*b* passes through the slot 71*x* formed on the side 71*b*. When the right guide member 80 is further moved toward the side wall 60*b*, the end of the protrusion 65 contacts the leaf spring 72. Accordingly, the leaf spring 72 is pushed by the protrusion 65 and deforms along the tapered portion 71*d* toward the left side in FIG. 4B where the B4-sized sheets 3 are to be mounted.

Figure 4A:
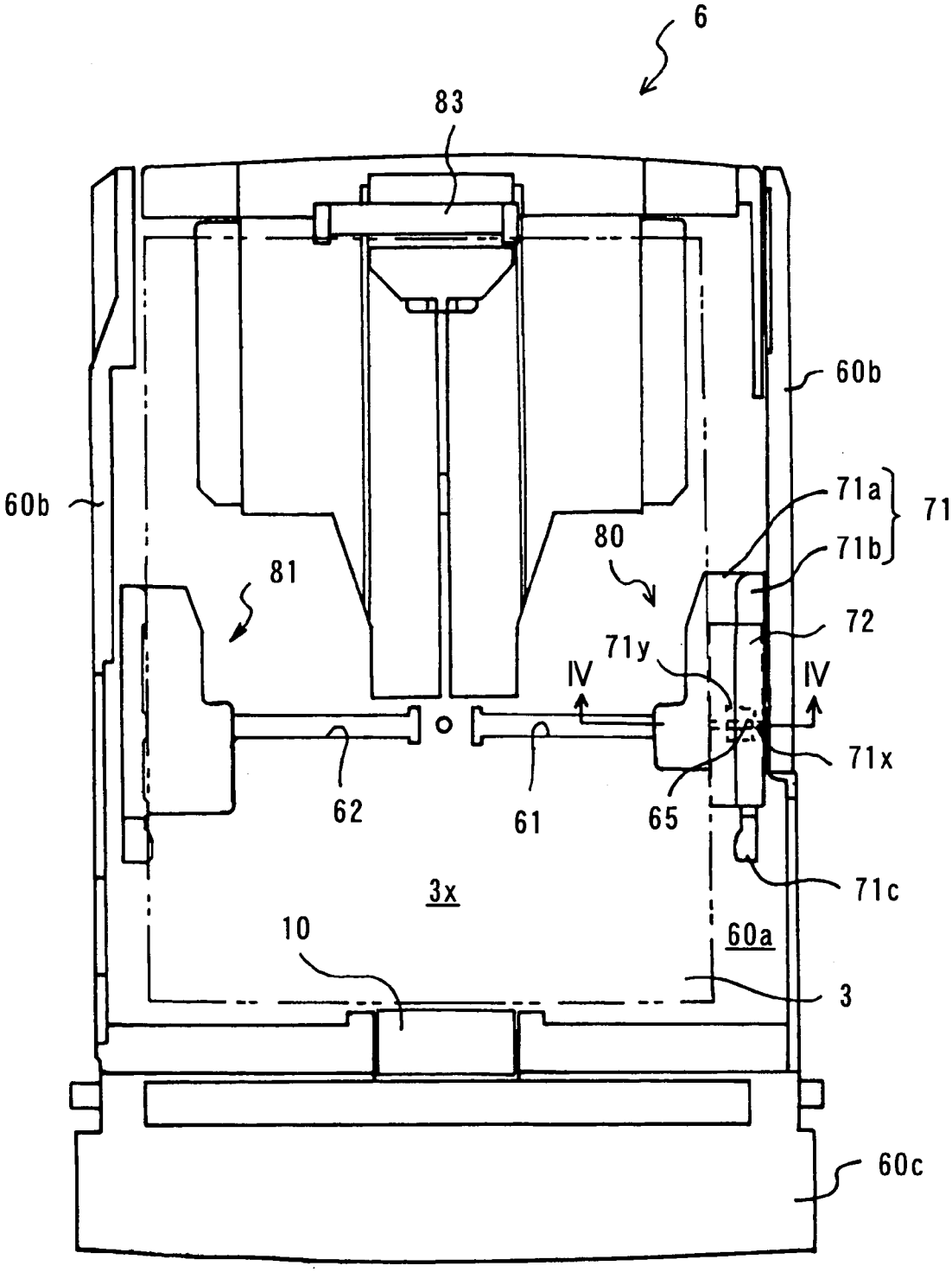
FIG. 4A is a plane view of the sheet feed cassette of the laser printer in which B4-sized sheets are mountable.
Figure 4B:
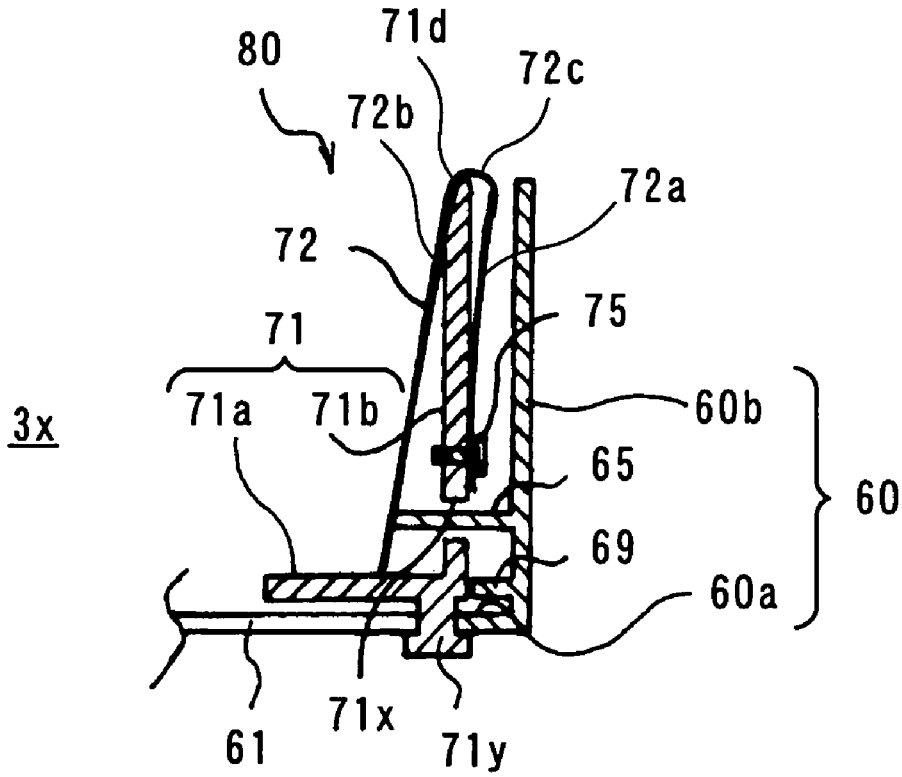
FIG. 4B is a cross sectional view of the sheet feed cassette taken along the line IV-IV of FIG. 4A.

As shown in FIG. 4B, the movement of the right guide member 80 including the slide member 71 and the leaf spring 72 toward the side wall 60*b* is stopped as the sliding portion 71*y* contacts the right end of the slide opening 61 formed in the bottom 60*a* and the end of the projection 69 disposed below the protrusion 65 contacts a lower portion of the side 71*b*.

The sheet accommodation area 3*x* shown in FIG. 4A corresponds to the size of the B4-sized sheet 3. As shown in FIG. 4B, the sheet accommodation area 3*x* gradually becomes larger toward an upward or sheet stacking direction in cross-sectional view, due to the deformation of the leaf spring 72.

The leaf spring 72 is deformed in FIG. 4B such that the connecting portion 72*c* is positioned nearer to the side wall

60*b*, as compared with the leaf spring 72 in FIG. 2B. The leaf spring 72 is thus deformed and consequently, the sheet accommodation area 3*x* is widened. With this structure, the sheets 3 may be readily set in the sheet accommodation area 3*x*, without contacting or hitting the connecting portion 72*c*. Accordingly, damage on the sheets 3 caused when the sheets 3 contacts or hits the connecting portion 72*c* during the sheet setting in the cassette 6, may be prevented.

In the embodiment, the leaf spring 72 can be deformed in association with the movement of the right guide member 80. Therefore, operations of the guide members 80, 81 to adjust to the sheet sizes may be efficiently performed in the embodiment, as compared with a case where the leaf spring 72 is deformed using a special device, such as a switching lever, in addition to the operations of the guide members to adjust to the sheet size.

The left guide member 81 has a side which does not have the slot 71*x*. The left guide member 81 has a similar component to the sliding portion 71*y* of the right guide member 80, so that the left guide member 81 is slidable along a slide opening 62 formed on the bottom 60*a* of the case 60.

As the slide member 71 is positioned near the side wall 60*b*, the maximum permissible size of the B4-sized sheets 3 may fit in the sheet accommodation area 3*x*. Thus, a compact design for the sheet feed cassette 6 may be achieved. When the slide member 71 is moved and positioned near the side wall 60*b*, the leaf spring 72 provided on the slide member 71 deforms, so that the sheet accommodation area 3*x* becomes larger toward the sheet stacking direction from the bottom 60*a*. Accordingly, the sheets 3 may be readily set in the sheet accommodation area 3*x* from above the case 60, without hitting the sheets 3 on the connecting portion 72*c* of the leaf spring 72. The sheet feed cassette 6 according to the embodiment achieves the compact design, as well as prevents damage on the sheets 3 when set in the cassette 6.

When the slide member 71 is positioned near the side wall 60*b*, as shown in FIGS. 4A and 4B, to accommodate the B4-sized sheets 3, the sheet accommodation area 3*x* in the case 60 gradually becomes larger toward the sheet stacking direction from the bottom 60*a*. Therefore, the sheets 3 may be smoothly set from the upper side of the case 60 toward the bottom 60*b*. Thus, sheet damage attributable to the sheet setting in the sheet feed cassette 6 may be prevented.

When the slide member 71 is positioned near the side wall 60*b*, the protrusion 65 contacts the leaf spring 72 through the slit 71*x* formed on the slide member 71, so that the free side 72*b* of the leaf spring 72 is pushed toward the sheet accommodation area 3*x*, to widen the sheet accommodation area 3*x*. With such a simple structure for the sheet feed cassette 6, the sheets 3 may be set without being damaged.

The end of the protrusion 65, which is provided on the side wall 60*b*, is rounded. Therefore, the protrusion 65 smoothly moves on the surface of the leaf spring 72 and accordingly the leaf spring 72 deforms smoothly. The smooth deformation of the leaf spring 72 is also achieved with the protrusion 65 disposed below the center of the leaf spring 72. Thus, the leaf spring 72 is deformed with a relatively low force.

The leaf spring 72 urges the longer side of the sheets 3. Alignment of the sheet sides along or parallel to the sheet feeding direction is an important factor for proper sheet feeding. Accordingly, the sheet feed cassette 6 may supply the sheets 3 properly with the sheet side urged by the leaf spring 72.

If the leaf spring 72 is fixed to the slide member 71 on the side of the free side 72*b*, the leaf spring 72 may not smoothly deform or the sheets 3 may be caught on a rivet or a screw that fixes the leaf spring 72 and the slide member 71. Such situations may be prevented in the sheet feed cassette 6 according to the embodiment, since the leaf spring 72 is fixed to the slide member 71 on the side of the fixed side 72*a*.

While the invention has been described with reference to the embodiment, it is to be understood that the invention is not restricted to the particular forms shown in the foregoing embodiment. Various modifications and alterations can be made thereto without departing from the scope of the invention, as set forth in the appended claims.

Figure 5:
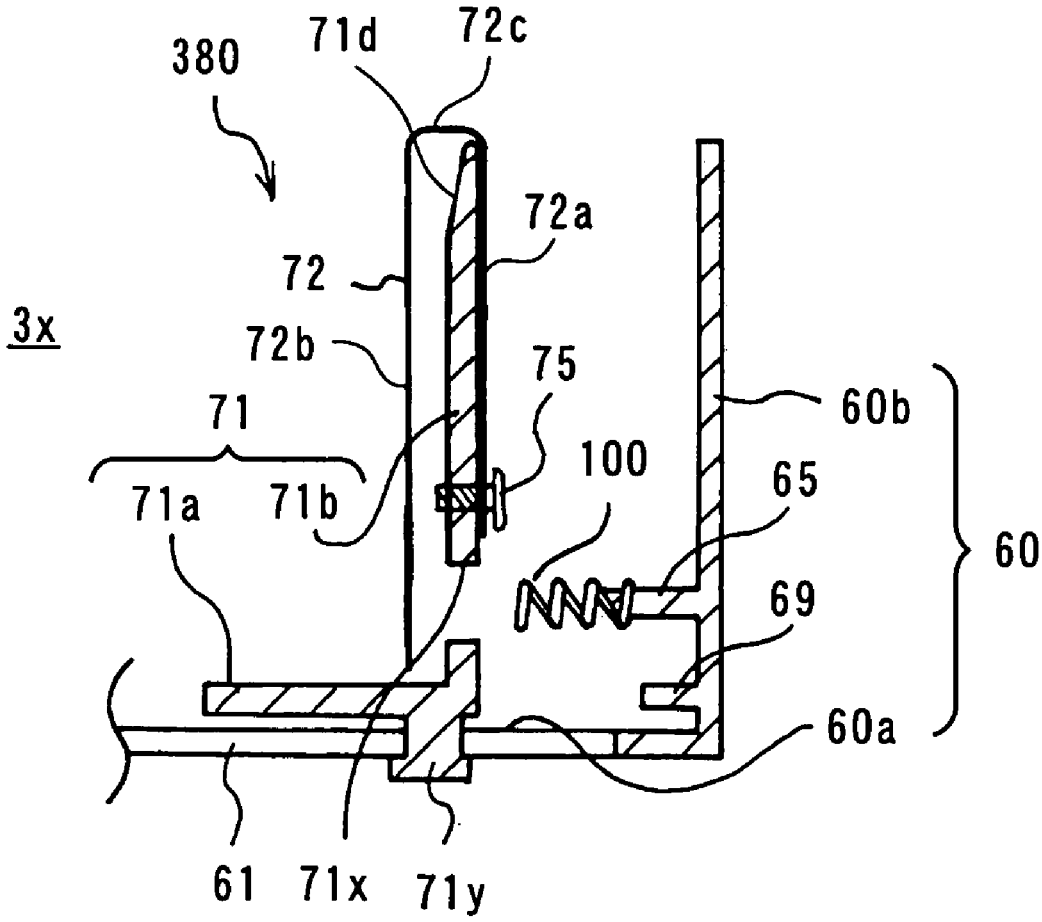
FIG. 5 is a cross sectional view of a guide member of a sheet feed cassette according to a modification of the embodiment.

For example, as shown in FIG. 5, a right guide member 380 according to a modification of the embodiment includes a spring 100 disposed at an end of the protrusion 65, which extends from the side wall 60*b* of the case 60, to give elastic force to the protrusion 65. If the protrusion 65 has the elastic force, application of excessive pressing force to the sheets 3 due to the deformation of the leaf spring 72 may be prevented. Therefore, the sheet warpage caused by the excessive pressing force application by the leaf spring 72 may be prevented.

Figure 6:
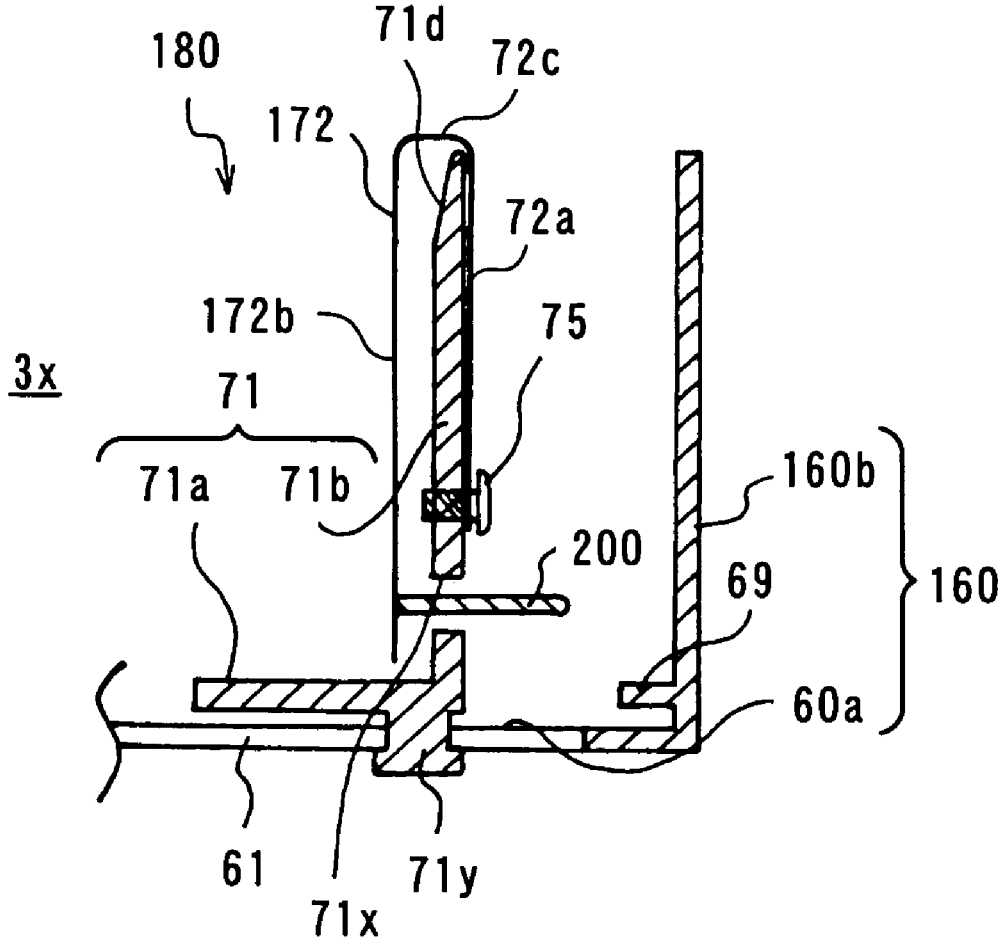
FIG. 6 is a cross sectional view of a guide member of a sheet feed cassette according to a modification of the embodiment.

In a right guide member 180 according to a modification of the embodiment, as shown in FIG. 6, the protrusion 65 does not extend from a side wall 160*b*, but a protrusion 200 extends toward the side wall 160*b* from a free side 172*b*, through the slit 71*x* formed on the slide member 71. As the right guide member 180 is moved toward the side wall 160*b*, the protrusion 200 contacts the side wall 160*b* through the slit 71*x*. Accordingly, the free side 172*b* of the leaf spring 172 is pushed toward the sheet accommodation area 3*x* and deformed. With this simple structure, the sheets 3 may be set in the sheet accommodation area 3*x* while preventing damage to the sheets 3.

In the embodiment, the leaf spring 72 deforms such that the sheet accommodation area 3*x* gradually becomes larger toward the sheet stacking direction. However, the sheet accommodation area 3*x* does not have to gradually become larger toward the sheet stacking direction, but the sheet accommodation area 3*x* at a position away from the bottom 60*a* in the sheet stacking direction may be larger than the sheet accommodation area 3*x* at a position near the bottom 60*a*. To prevent damage to the sheets 3, it is preferable that the sheet accommodation area 3*x* gradually become larger toward the sheet stacking direction, similar to the embodiment.

The position of the protrusion 65, 200 is not limited to below the center of the leaf spring 72. However, it is preferable that the protrusion 65, 200 be disposed below the center of the leaf spring 72 to smoothly deform the leaf spring 72.

Figure 7:
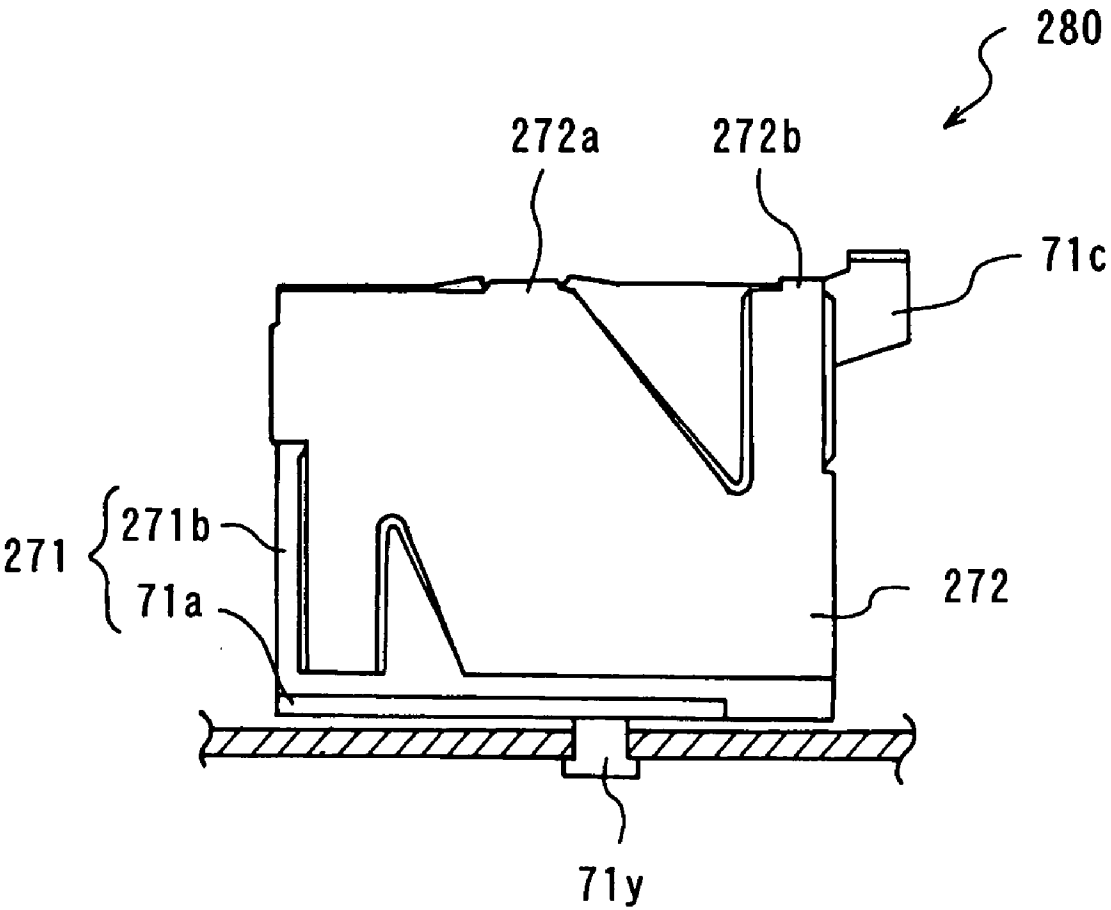
FIG. 7 is a side view of a leaf spring of a guide member of sheet feed cassette according to a modification of the embodiment.

The leaf spring 72 is of a substantially rectangular shape. However, the shape of the leaf spring 72 is not limited to the rectangular shape. For example, as shown in FIG. 7, a substantially "N"-shaped leaf spring 272 may be used for a right guide member 280. In this case, the sheets 3 may be accommodated in the case 60 to incline toward an upper right direction in FIG. 7 when the leaf spring 272 is oriented to correctly read the letter of "N". Using the right guide member 280 including the substantially "N"-shaped leaf spring 272, the sides of the sheets 3 are urged without applying excessive force to the sheets 3. As shown in FIG. 7, the leaf spring 272 has hooks 272*a*, 272*b* that are fixed to a side 271*b* of a slide member 271.

An urging member that urges one side of the sheet 3 may be used other than the leaf spring 72. A deformation device or actuator that deforms or transforms the urging member is not limited to the protrusion 65, 200 or the slit 71*x* but other devices may be used.

Two different sizes of A4 and B4-sized sheets 3 are mountable on the sheet feed cassette 6 according to the embodiment. However, the sheet feed cassette 6 may be structured to accommodate more than two different sizes of sheets 3 or various sizes of sheets 3.

The right and left guide member 80, 81 have different structures. However, the left guide member 81 may be structured similar to the right guide member 80. The number of the guide members is not limited to two, but only one guide member may be used for the sheet feed cassette 6. The sheet feed cassette 6 may adopt a single-side registration system, other than the center registration system.

The guide members 80, 81 guides parallel edges of the sheets 3 to the sheet feeding direction. However, edges of the sheets 3 perpendicular to the sheet feeding direction may be guided by a guide member.

The embodiment is described in conjunction with a laser printer of an image forming device. However, the image forming device is not limited to the laser printer, but the invention may be applied to other printers, such as inkjet printers, copiers, and facsimile machines.

What is claimed is:

1. A sheet feed cassette, comprising:

a case that accommodates a stack of recording mediums;

a slide member, provided inside of the case, slidably disposed in association with a size of the stack of recording mediums, the case and the slide member determining an accommodating area that accommodates the stack of recording mediums;

an urging member, provided at the slide member that faces one side of the stack of recording mediums, that urges the one side of the stack of recording mediums; and an actuator that transforms the urging member such that the accommodating area at a top portion of the case is larger than the accommodating area at a bottom portion of the case, wherein the slide member slides within a slide opening of the case in a width direction of the recording mediums, and wherein the urging member is deformed in association with the movement of the slide member.

2. The sheet feed cassette according to claim 1, wherein the actuator transforms the urging member such that the accommodating area at the top portion of the case gradually becomes larger from the bottom portion of the case toward the top portion of the case.

3. The sheet feed cassette according to claim 1, wherein the actuator includes a protrusion projecting from the case toward the urging member inside of the case, the protrusion transforming the urging member.

4. The sheet feed cassette according to claim 3, wherein the slide member includes an aperture through which the protrusion passes to transform the urging member.

5. The sheet feed cassette according to claim 4, wherein the urging member is formed in a U-shape and includes a fixed portion, a free portion and a connecting portion, the fixed portion being opposite to the free portion and being fixed at the slide member, the connecting portion being between the fixed portion and the free portion with the protrusion passing through the aperture and contacting the free portion.

6. The sheet feed cassette according to claim 3, wherein the protrusion transforms the urging member when the slide member is positioned adjacent to a side wall of the case.

7. The sheet feed cassette according to claim 3, wherein a tip of the protrusion is round.

8. The sheet feed cassette according to claim 3, wherein the protrusion contacts the urging member below a center of the urging member.

9. The sheet feed cassette according to claim 3, wherein the protrusion has elasticity.

10. The sheet feed cassette according to claim 3, wherein the protrusion includes a spring disposed at an end of the protrusion.

11. The sheet feed cassette according to claim 3, wherein the urging member is substantially N-shaped.

12. The sheet feed cassette according to claim 1, wherein the slide member includes a tapered portion along which the urging member is transformed.

13. The sheet feed cassette according to claim 1, wherein the actuator includes a protrusion projecting from the slide member toward a side wall of the case, the urging member being transformed when the protrusion contacts the side wall of the case.

14. The sheet feed cassette according to claim 13, wherein the slide member includes an aperture through which the protrusion passes.

15. The sheet feed cassette according to claim 14, wherein the urging member is formed in a U-shape and includes a fixed portion, a free portion and a connecting portion, the fixed portion being opposite to the free portion and being fixed at the slide member, the connecting portion being between the fixed portion and the free portion with the protrusion being formed at the free portion.

16. The sheet feed cassette according to claim 13, wherein the protrusion is formed at a lower portion of the urging member.

17. The sheet feed cassette according to claim 13, wherein the protrusion has elasticity.

18. An image forming device comprising the sheet feed cassette of claim 1.

19. A sheet feed cassette, comprising:

a case that accommodates a stack of recording mediums;

a slide member, provided inside of the case, slidably disposed in association with a size of the stack of recording mediums, the case and the slide member determining an accommodating area that accommodates the stack of recording mediums; and an urging member, provided at the slide member that faces one side of the stack of recording mediums, that is movable between a first position where a side of the slide member and a side of the urging member that faces the stack of recording mediums is substantially parallel and a second position where the side of the slide member and the side of the urging member that faces the stack of recording mediums is not substantially parallel, wherein the slide member slides within a slide opening of the case in a width direction of the recording mediums, and wherein the urging member is deformed in association with the movement of the slide member.

20. The sheet feed cassette according to claim 19, wherein an actuator transforms the urging device between the first position and the second position.

* * * * *